US007065922B1

(12) United States Patent
De Kruijf et al.

(10) Patent No.: US 7,065,922 B1
(45) Date of Patent: Jun. 27, 2006

(54) LOCKING MECHANISM FOR A GATE

(75) Inventors: Wilhelmus Petrus Johannes De Kruijf, Enschede (NL); Berry Meems, Borne (NL); Hendrikus Johannes Vertegaal, Borne (NL)

(73) Assignee: Nubis B.V. (NL)

( * ) Notice: Subject to any disclaimer, the term of this patent is extended or adjusted under 35 U.S.C. 154(b) by 282 days.

(21) Appl. No.: 10/048,254

(22) PCT Filed: Jul. 28, 2000

(86) PCT No.: PCT/NL00/00540

§ 371 (c)(1),
(2), (4) Date: Jun. 11, 2002

(87) PCT Pub. No.: WO01/09476

PCT Pub. Date: Feb. 8, 2001

(30) Foreign Application Priority Data

Jul. 29, 1999 (NL) ..... 1012728
Apr. 5, 2000 (NL) ..... 1014844

(51) Int. Cl.
*E05B 65/06* (2006.01)

(52) U.S. Cl. ..... 49/57; 49/394; 49/463; 292/DIG. 27; 292/212

(58) Field of Classification Search ..... 49/394, 49/55, 57, 463, 465; 292/DIG. 29, DIG. 27, 292/DIG. 2, 176, 251, 58, 57, 155, 212; 150/155
See application file for complete search history.

(56) References Cited

U.S. PATENT DOCUMENTS

| | | | | | |
|---|---|---|---|---|---|
| 187,141 | A | * | 2/1877 | Hoyt | 292/251 |
| 925,644 | A | * | 6/1909 | Luden | 292/155 |
| 1,236,037 | A | * | 8/1917 | Andreas | 292/251 |
| 1,381,696 | A | * | 6/1921 | Bernhard | 292/176 |
| 1,712,039 | A | * | 5/1929 | Hopkins | 116/153 |
| 1,723,007 | A | * | 8/1929 | Bittorf | 292/57 |
| 2,781,220 | A | * | 2/1957 | Zietlow | 292/347 |
| 3,174,788 | A | * | 3/1965 | Williams | 292/347 |
| 3,937,504 | A | * | 2/1976 | McElroy | 292/164 |
| 4,353,139 | A | * | 10/1982 | Wainwright et al. | 4/661 |
| 4,787,174 | A | * | 11/1988 | Brown | 49/55 |
| 4,790,578 | A | * | 12/1988 | Barrera | 292/148 |
| 4,846,246 | A | * | 7/1989 | Stern | 160/224 |
| 4,869,305 | A | * | 9/1989 | Jones | 150/155 |
| 5,052,461 | A | | 10/1991 | Stern | |
| 5,060,421 | A | * | 10/1991 | Castelli | 49/463 |
| 5,253,904 | A | * | 10/1993 | Ruby | 292/58 |
| 5,280,973 | A | * | 1/1994 | Culling | 292/58 |
| 5,575,113 | A | * | 11/1996 | Huang | 49/55 |
| 5,617,674 | A | * | 4/1997 | Terrill | 49/55 |
| 5,632,514 | A | * | 5/1997 | Johnson, Jr. | 292/95 |
| 5,829,505 | A | * | 11/1998 | Brescia | 160/225 |
| 5,924,242 | A | * | 7/1999 | Macari et al. | 49/55 |
| 6,016,629 | A | * | 1/2000 | Sylvester et al. | 49/55 |
| 6,681,523 | B1 | * | 1/2004 | Stener | 49/55 |

* cited by examiner

FOREIGN PATENT DOCUMENTS

DE 4414989 8/1995

*Primary Examiner*—Gregory J. Strimbu
(74) *Attorney, Agent, or Firm*—The Webb Law Firm

(57) ABSTRACT

A locking mechanism for a stair gate, comprising a displaceable latching member and an operating element which can engage on the latching member, wherein in a non-loaded state the operating element substantially releases the latching member and in a loaded state the operating element engages on the latching member, wherein for engagement on the latching member, the operating element is loaded in a direction varying from an operating direction of the latching member.

12 Claims, 10 Drawing Sheets

LOCKING MECHANISM FOR A GATE

BACKGROUND OF THE INVENTION

1) Field of the Invention

The invention relates to a locking mechanism for a stair gate, comprising a displaceable latching member and an operating element which can engage on the latching member. The invention also relates to a stair gate provided with such a locking mechanism. The invention furthermore provides a gate for closing off an opening between two vertical, fixedly disposed pans, wherein the gate comprises at least one hinge for hingedly mounting the gate on one of the vertical parts; and a locking mechanism for releasably coupling the part of the gate remote from the hinge to the other vertical part.

2) Brief Description of the Prior Art

Gates, particularly stair gates, are known in diverse embodiments and have as their most important function the screening off or blocking of a staircase in order to prevent undesired stair use. Stair gates generally consist of two frame parts with bars. These frame parts can slide along each other and fastened in order to thus close off the whole stairway opening. Stair gates are applied particularly in order to prevent undesired stair use by children and domestic pets. A stair gate is usually provided with mounting hardware with which the stair gate can be pivotally connected on one side to fixed components and with which the stair gate can be releasably coupled to fixed components by displacing a latching member at a distance from the pivotal connection. In order to particularly prevent undesired opening of a closed stair gate, the locking mechanism of stair gates is generally provided with a secured closing mechanism which is not easily opened by children or pets. The existing locking mechanism usually requires operation with two hands and is therefore not practical in use. In addition, the existing protected locking mechanism is of complex construction and not very durable. Other existing locking mechanisms which can be opened with one hand usually require an actuating force which is normally greater than 50 Newton, which is a force which cannot be overcome by a child. Another drawback of many existing stair gates is that they can only be closed by active operation of the locking mechanism. An example of a stair gate operable with one hand is described in the U.S. Pat. No. 5,052,461. In view of the plurality of transmissions between the operating handle and the bolts displaceable thereby, opening of this gate requires a considerable force. Another drawback is that the handle is situated at a limited distance from the hinge, whereby opening and closing is less simple. Finally, the construction of the described stair gate is complex and thereby also susceptible to malfunction.

The present invention has for its objective to provide an improved locking mechanism for a stair gate as well as a stair gate provided with such a locking mechanism, whereby the above stated drawbacks are obviated or at least reduced while the advantages of the prior art are retained. The invention also has for its object to provide a stair gate which is inexpensive and attractive.

SUMMARY OF THE INVENTION

The invention provides for this purpose a locking mechanism. The locking mechanism can thus be operated with only one hand; the operating element must be gripped and loaded in a direction differing from an operating direction such that it thereby engages on the latching member, and the latching member can then be simultaneously displaced by displacing the operating element. This operation requires a hand coordination such that operation is impossible for children and pets on the one hand but relatively simple for adults on the other. Depending on the desired specifications of use the operating element can be manufactured such that a determined minimal gripping force must be produced to cause engagement of the operating element. Another significant advantage of the locking mechanism according to the invention is that it can be manufactured very simply and at relatively low cost and is little susceptible to malfunction.

In a possible embodiment of the locking mechanism according to the invention the locking mechanism is characterized in that the operating element is axially displaceable relative to the operating element between a coupled position, in which the operating element is coupled to the latching member, and an uncoupled position, in which the operating element releases the latching member; and that spring means are arranged between the operating member and the latching member to urge the operating member into the uncoupled position. With such a locking mechanism it is possible to couple the latching member by pushing in or pulling the operating member, whereafter the latching means can be unlocked by rotating the operating member.

In another embodiment of the locking mechanism according to the invention the operating element is deformable such that in a non-loaded state it substantially releases the latching member and in a deformed state it engages on the latching member. The extra coordination required in addition to displacing of the latching member in this embodiment is compressing/deforming.

In a preferred embodiment the latching member is mounted displaceably in at least one guide. The freedom of movement of the latching member is limited by means of the guide and the position thereof is determined without this conflicting with the functionality being sought after.

In another preferred embodiment the latching member is provided with a profiled surface part for co-action with a contact surface of the operating element directed toward the latching member. The contact surface of the operating element directed toward the latching member is preferably provided herein with a counter-profile. Owing to these measures a good engagement of the operating element on the latching member can be realized, this being desirable for optimal functioning of the locking mechanism. A good coupling between latching member and (deformed) operating element can thus also be realized in difficult conditions, such as for instance in the case of a jamming latching member or in damp conditions of use. As profile can for instance be envisaged an anti-slip layer, but also for instance a toothing with a counter-toothing as counter-profile.

In yet another preferred embodiment an end of the latching member remote from the operating element is embodied as locking pin which is for instance linearly displaceable. The latching member can thus engage directly on for instance a lock plate which is connected to fixed components without the locking mechanism requiring extra components for this purpose.

Yet another embodiment variant is characterized in that the latching member is provided with a substantially helical guide. The kinematic reversal, a helical guide on which the latching member engages, likewise forms part of the present invention. When such a latching member is rotated using the operating member, this will result in an axial displacement of the latching member. A simple axial displacement is thus enabled for locking purposes by a rotating movement of the operating member which is simple in respect of operation.

When it is not desired that the locking pin also make a rotating movement, the latching member can engage rotatably on a locking pin which is only linearly displaceable. It is hereby possible to prevent a rotating movement of the latching member being transmitted to the locking pin; only the axial displacement of the latching member need be transmitted.

The operating element, at least in the case of a deformable operating element, is preferably manufactured from a flexible plastic, such as for instance a rubber. The operating element must be deformable with a determined pressure of for instance some tens of Newton such that it engages on the latching member and must also return to the original form when the load is relieved. It must furthermore be possible for this change of form to take place frequently without this resulting in permanent changes of form. This functionality can be realized in particularly favourable and advantageous manner using a plastic operating element.

The invention also provides a gate. The locking mechanism can thus form part of a gate, such as a stair gate, in integrated manner, this being a certain and advantageous assembly of the components. These advantages are present particularly when the gate is manufactured from a plastic. In the production process of the gate a part of the locking mechanism, in particular the guide of the latching member, can then be manufactured simultaneously.

In an embodiment according to the invention the latching means comprise a pin with a relatively wide and a relatively narrow part and a latching member, which latching member comprises a hole with a relevant dimension greater than the relevant dimension of the wide part of the pin and a slot extending from an outer surface to the hole, which slot has a width greater than the relevant dimension of the narrow part of the pin and smaller than the relevant dimension of the wide part of the pin, wherein the latching means can be carried into a locked or an unlocked position by axial displacement of the pin. The latching member herein preferable comprises an upper surface running obliquely upward, wherein the relatively wide part of the pin undergoes an axial displacement when it slides thereover. It hereby becomes possible to push the gate shut from an opened position without the locking mechanism having to be operated. This is possible in that the pin is shifted axially by engaging on the upper surface running obliquely upward. Instead of this embodiment other constructions can of course also be envisaged for a pin and an opening co-acting therewith. Instead of having a narrowed part the pin can thus for instance also have a single or double pin engaging from respectively one or two sides on a completely closed opening in a latching member. Yet another possibility is to provide the pin with a projecting part and/or a bent part, whereby a continuous opening in the latching member itself can become unnecessary.

In another embodiment of the gate according to the invention the latching means comprise second spring means for urging the pin into the locked position. When the gate is pushed shut, the pin will displace axially due to the upper surface running obliquely upward. In order to ensure a good closure the second spring means will urge the relatively wide part of the pin into the hole of the latching member, whereby the locking of the gate is brought about efficiently.

The invention moreover provides a gate. There has been a legal standard for stair gates (EN1930) for some time now. According to this standard it is necessary that the openings are not between 5 mm and 12 mm, between 25 mm and 45 mm and greater than 65 mm. This is prohibited in respect of the catching hazard for arms, fingers, wrists, knees, feet and legs of children. With a gate according to the invention such openings are precluded since the gate is assembled from two, or optionally more, plate-like closed parts.

In one embodiment at least one plate-like part can herein be transparent. It is hereby possible to look through the gate and to see what is situated behind the gate. This can be safe and comfortable for both the child and the adult.

For certain safeguarding against undesired opening, the stair gate is preferably embodied such that the latching member is at least substantially screened off from the environment. It is hereby difficult or even impossible to grip the latching member directly and then move it. When the latching member is completely screened off from the environment, for instance in that the latching member is screened off from the environment by the guide, the operating element and the stair gate, the latching member can only be displaced by the operating element, which provides the desired safety.

BRIEF DESCRIPTION OF THE DRAWINGS

The present invention will be further elucidated with reference to the non-limitative embodiments shown in the following figures. Herein.

DETAILED DESCRIPTION OF THE PREFERRED EMBODIMENTS

Figure 1:
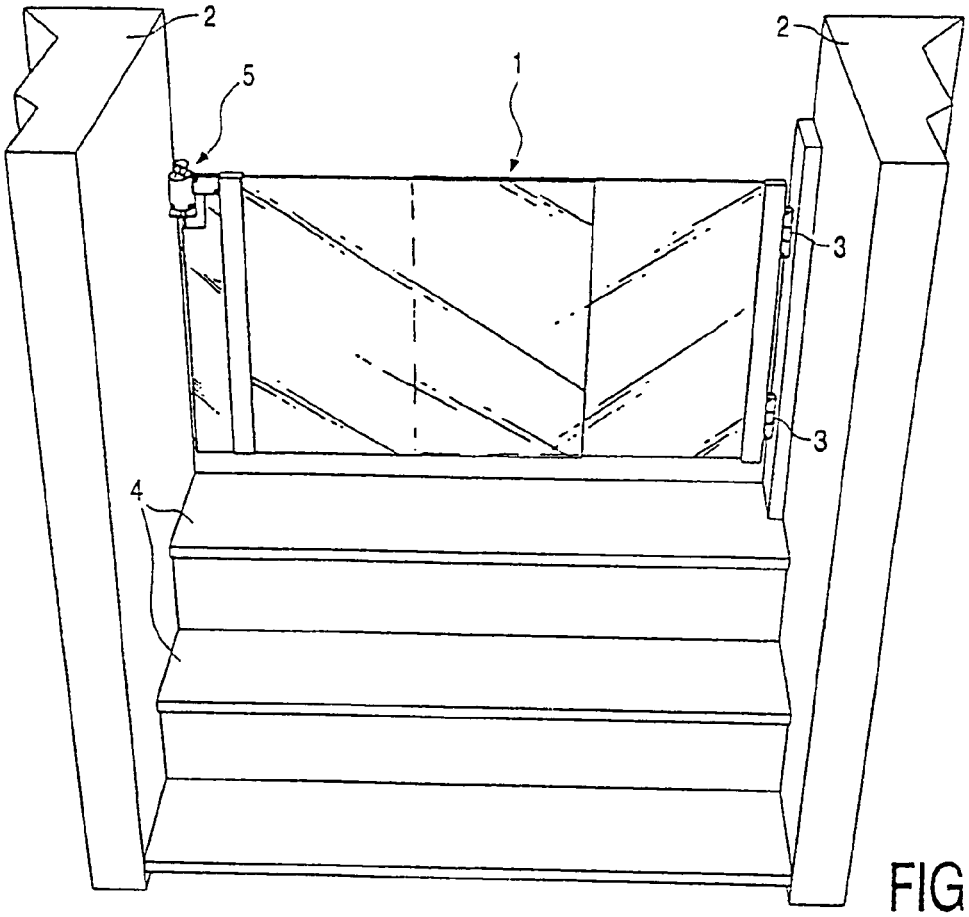
FIG. 1 shows a perspective view of a first embodiment of a gate according to the invention.

FIG. 1 shows an embodiment of a stair gate 1 according to the invention. This stair gate 1 is arranged at the top of a staircase 4 between two vertical wall parts 2 by means of hinges 3. Stair gate 1 can be closed by a locking mechanism 5.

Figure 2:
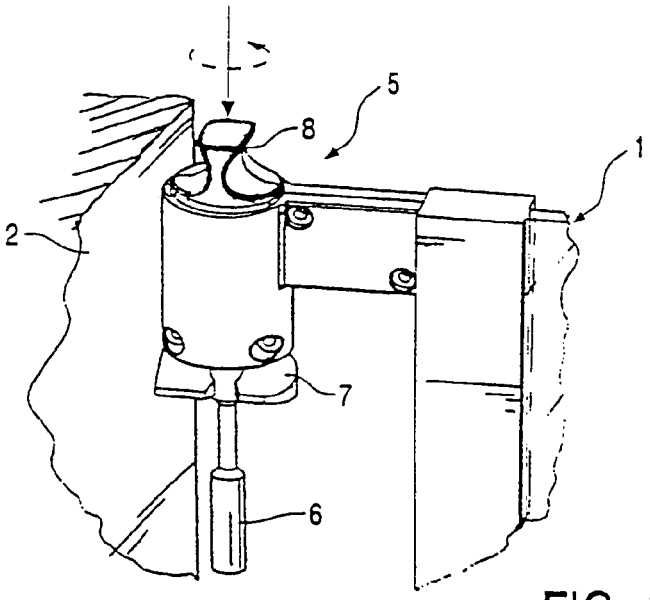
FIG. 2 shows a perspective detail view of the locking mechanism with axially displaceable operating member of the gate according to FIG. 1.

FIG. 2 shows an enlarged view of locking mechanism 5 with an axially displaceable operating member 8. This locking mechanism 5 is fixedly connected to stair gate 1. A locking pin 6 co-acts with a wedge-shaped latching member 7 which is arranged on vertical wall part 2. Locking mechanism 5 further comprises operating member 8, with which the locking pin 6 can be disconnected from latching member 7 by being simultaneously pressed and turned.

Figure 3:
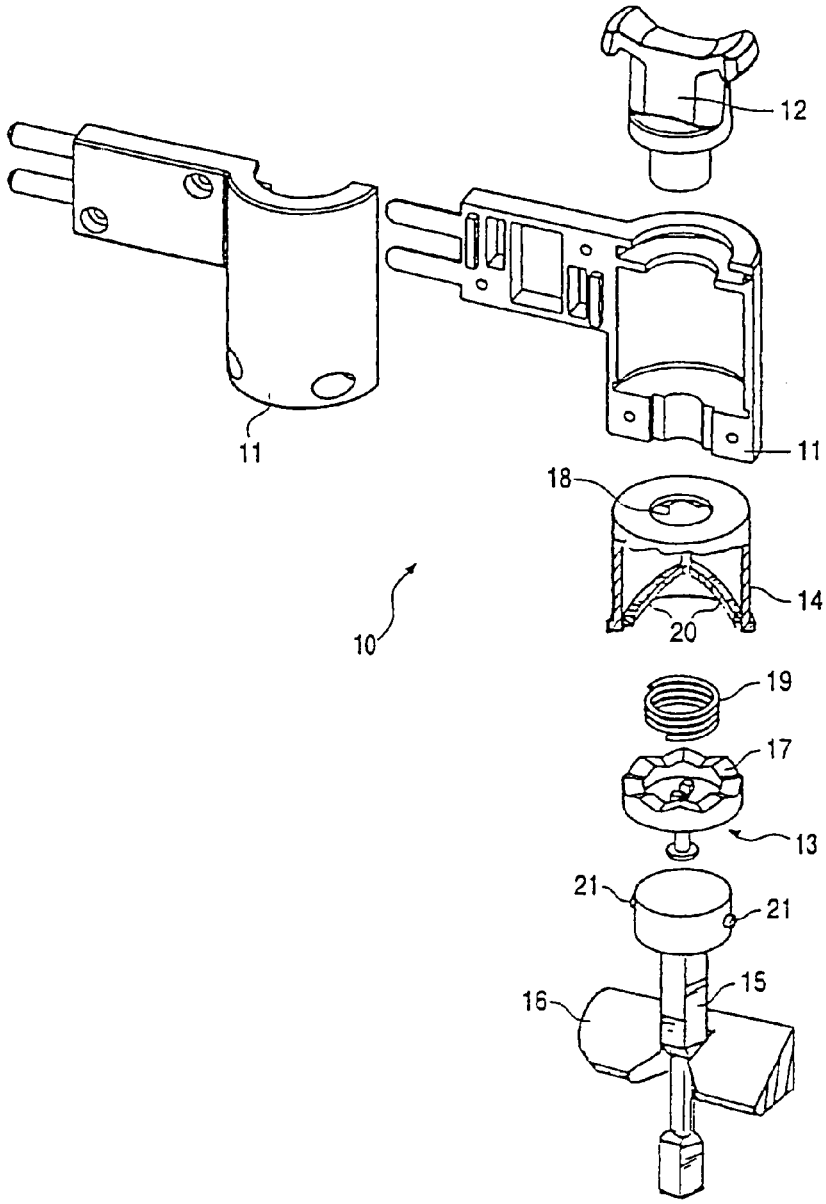
FIG. 3 is a perspective view of a first embodiment of a locking mechanism with axially displaceable operating member with exploded parts according to the invention.

FIG. 3 shows a first embodiment of a locking mechanism 10 with an axially displaceable operating member 12. Locking mechanism 10 comprises two housing parts 11. These housing parts 11 are adapted to receive an operating member 12, a ring 13 which is coupled thereto and provided with a toothing 17, a latching member 14 and a locking pin 15. This locking pin 15, which in this embodiment has a square cross-section, co-acts with a latching member 16 which can be fixed to a vertical wall part. On an inner surface the latching member 14 likewise comprises a toothing 18 which can co-act for rotatable coupling with the toothing 17 on ring 13. A spring 19 is further arranged in the housing for the purpose of urging apart the latching member 14 and ring 13.

Latching member 14 is provided with two helical ribs 20 on the surface of the inner periphery. These ribs 20 co-act with two cams 21 arranged on locking pin 15 so that locking pin 15 is lifted upward out of latching member 16 by rotation of the latching member.

Figure 4:
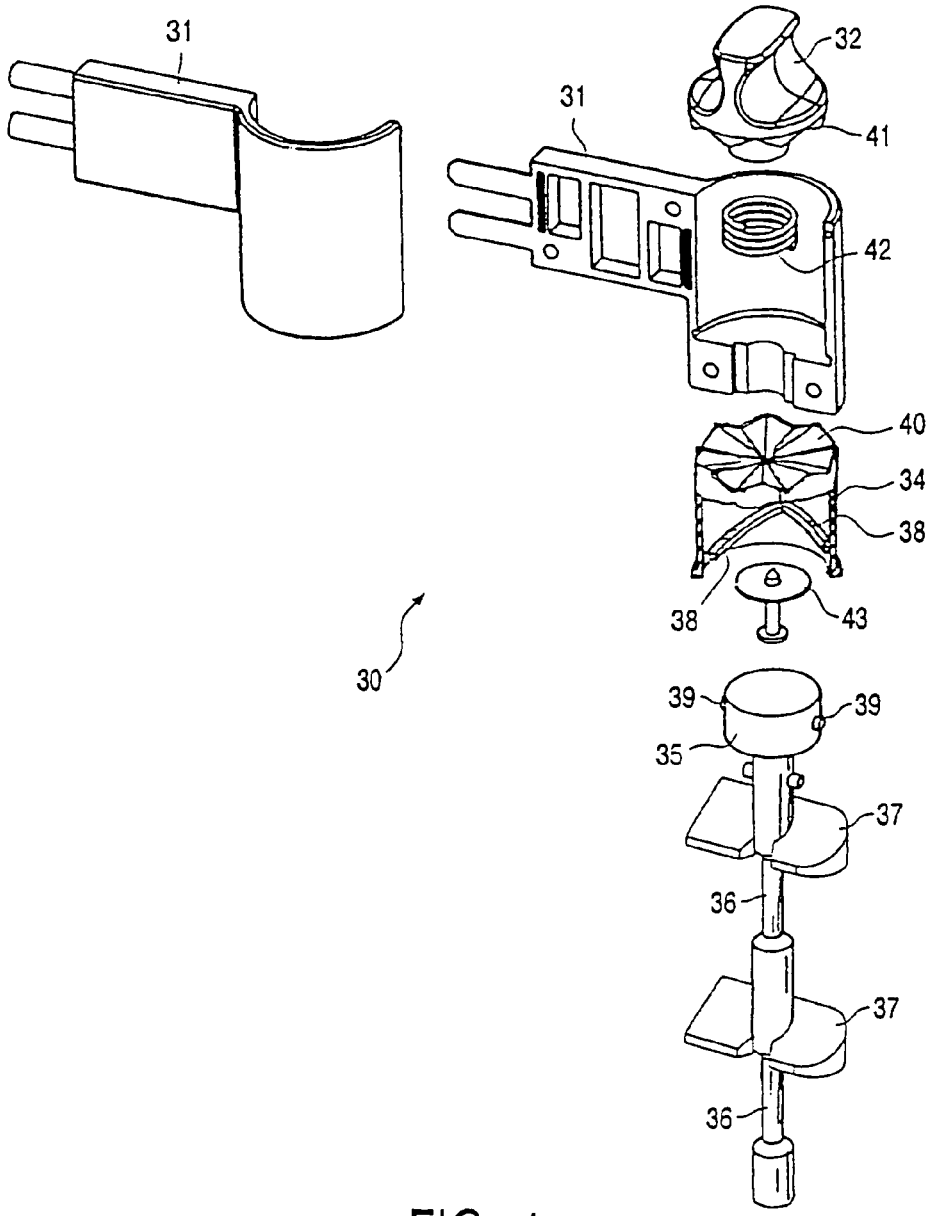
FIG. 4 is a perspective view of a second embodiment of a locking mechanism with axial operating member with exploded parts according to the invention.

FIG. 4 shows a second embodiment of a locking mechanism 30 according to the invention. This locking mechanism 30 also comprises two housing parts 31, in which an operating member 32, a latching member 34 and a locking pin 35 are received. Locking pin 35 is provided in this embodiment with two narrowed portions 36, which each fall into a latching member 37. Latching, member 34 has on its inner surface two helical ribs 38 which co-act with cams 39 arranged on locking pin 35.

The upper side of latching member 34 is provided with a toothing 40, which co-acts with a toothing 41 arranged on operating member 32. A spring 42 is arranged between operating member 32 and latching member 34 for the purpose of urging apart operating member 32 and latching member 34. In order to limit urging apart of the two parts 32, 34, a bounding part 34 is arranged on operating member 32.

Figure 5A:
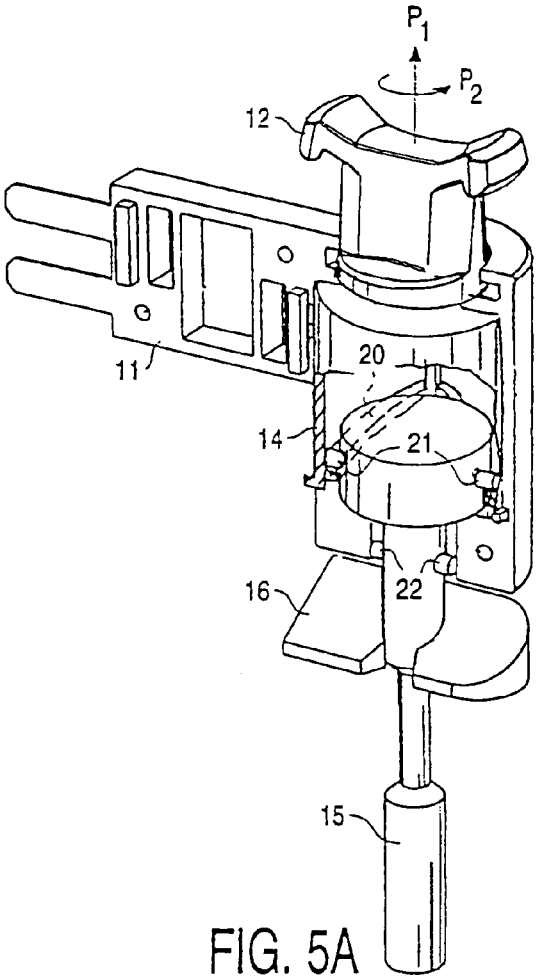
FIGS. 5A and 5B show respectively a perspective view of the locking mechanism of FIG. 3 with broken away parts and a cross-section of the locking mechanism of FIG. 3, FIGS. 6A and 6B show respectively a cross-section and a perspective view of the locking mechanism according to FIG. 4 with broken away parts.
Figure 5B:
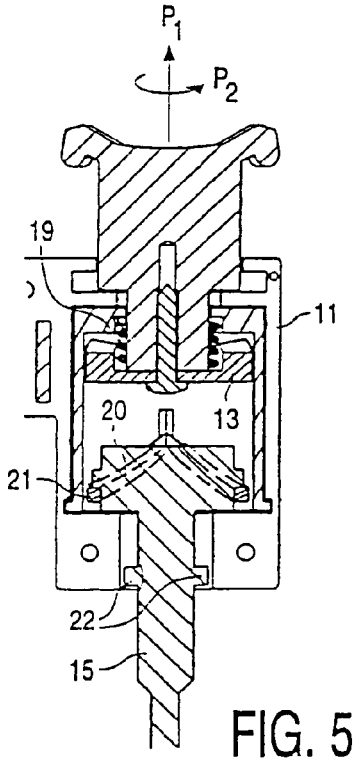

In FIGS. 5A and 5B the locking mechanism 10 is shown in assembled state. The operation hereof is as follows. Operating member 12 is pulled upward in the direction of arrow P1. Toothings 17 and 18 hereby enter into mutual engagement counter to the action of spring 19. By now rotating operating member 12 in the direction of arrow P2, the latching member 14 will also rotate. Through rotation of the latching member 14 the cams 21 of the locking pin will run upward along ribs 20, so that locking pin 15 can leave latching member 16. The rotation of locking pin 15 is prevented by second cams 22.

Figure 6A:
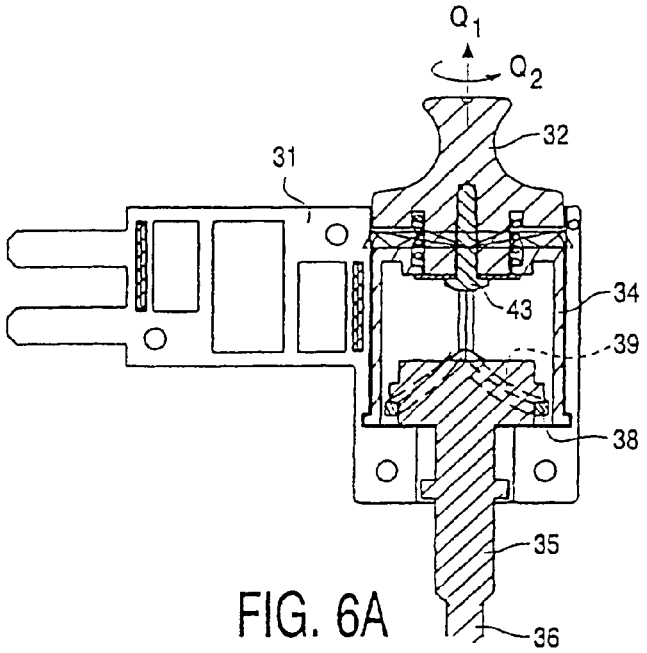
Figure 6B:
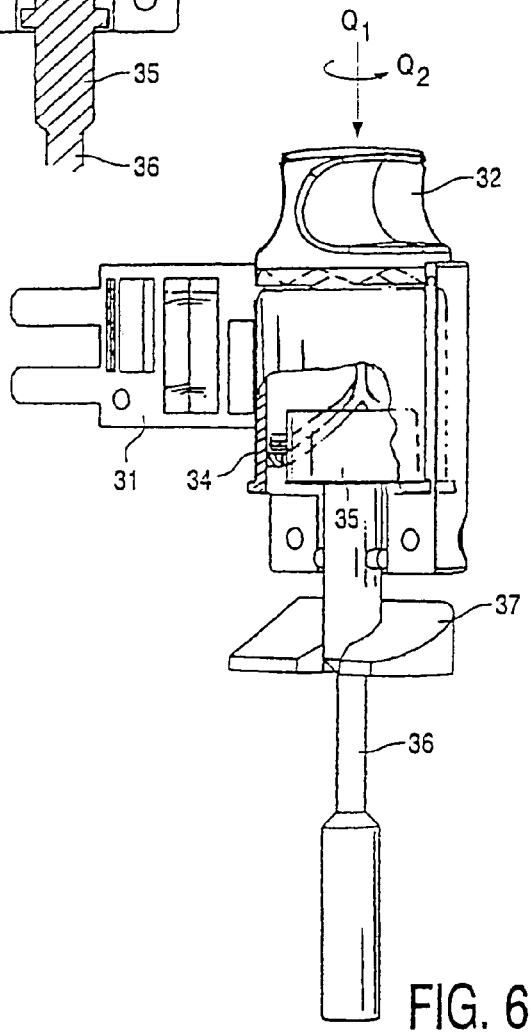

In FIGS. 6A and 6B the second embodiment of locking mechanism 30 is shown in assembled state. The operation of this locking mechanism 30 is practically identical to that of locking mechanism 10. In the case of locking mechanism 30 however, the operating member 32 must be depressed in the direction of arrow Q1, whereafter locking pin 35 can be removed from latching member 37 by rotation in the direction of arrow Q2.

Latching member 16, 37 is preferably wedge-shaped. By pressing the locking pin against the latching member it is hereby possible to press this locking pin upward, whereby the pin drops into the latching member. A second spring can herein be provided to urge the locking pin downward.

Figure 7:
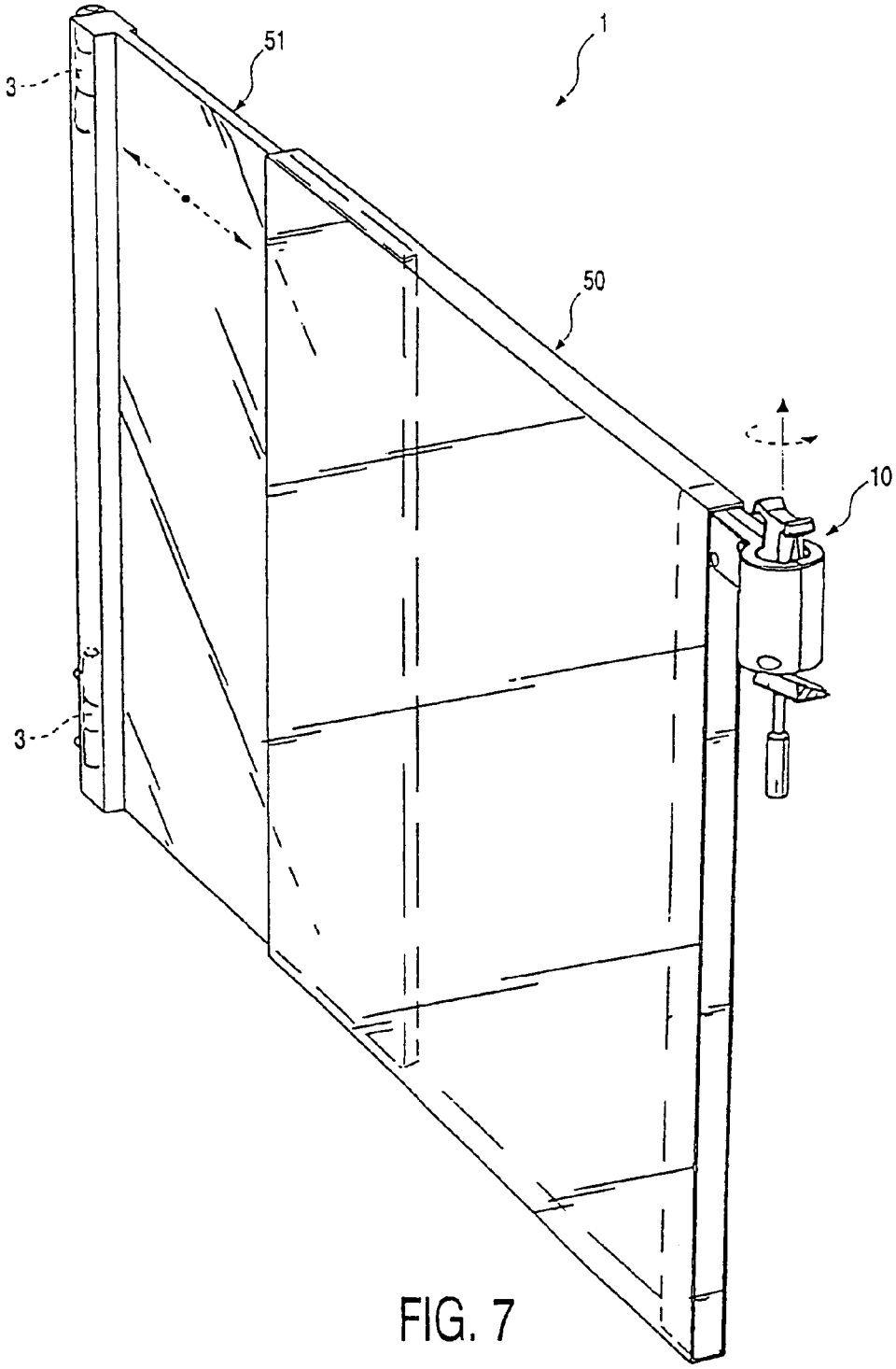
FIG. 7 is a perspective view of the gate according to FIG. 1.

FIG. 7 shows an embodiment of a stair gate 1 according to the invention. This stair gate comprises two panels 50, 51 which can slide one into the other. It is hereby possible to adjust the width of stair gate 1 to the distance between vertical wall parts 2 (see FIG. 1). Panels 50, 51 are preferably transparent and manufactured from polycarbonate, impact-resistant polystyrene or acrylate.

Although a stair gate consisting of two panels is shown in FIG. 7, it is of course also possible to arrange two slidable side panels on either side of a panel. The stair gate 1 hereby acquires a symmetric appearance. In another possible embodiment the stair gate consists of two transparent panels which slide along each other (instead of into each other).

Figure 8:
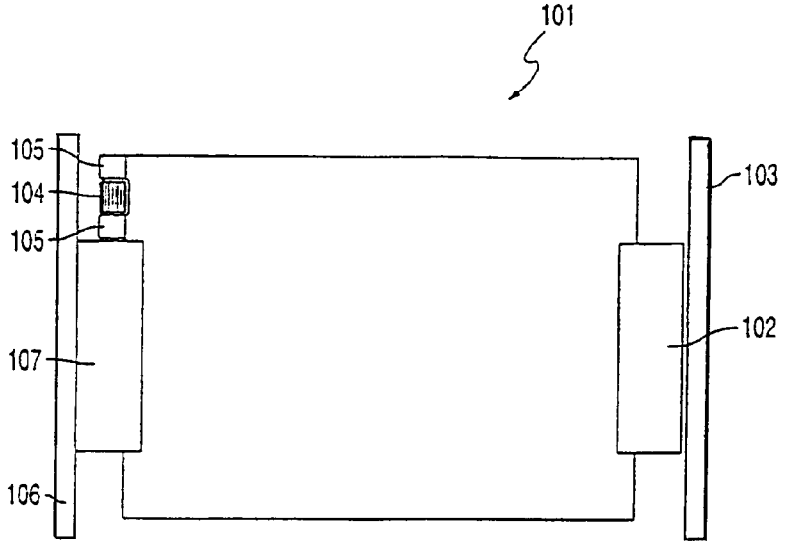
FIG. 8 is a schematic front view of yet another variant of the stair gate according to the invention with a deformable operating member.

FIG. 8 shows a stair gate 101 which by means of a schematically shown hinge 102 is pivotally connected to a post 103 which forms part of fixed components. Situated on the side of stair gate 101 remote from hinge 102 is an operating element 104 which consists of a rotatable sleeve. Operating element is enclosed between two projecting parts 105 of stair gate 101. On the side of stair gate 101 remote from hinge 102 is also situated a stop 107 which is connected to a fixed upright 106 and against which stair gate 101 closes. In the stop 107 is also arranged an opening or pin housing, not shown in the figure, into which a locking pin, likewise not shown, can slide to lock stair gate 101. In order to operate the locking pin the sleeve 104 must be compressed and rotated. This will be further elucidated with reference to FIGS. 9 and 10. Uprights 103, 106 consist for instance of frames, walls, balusters or other fixed objects.

Figure 9:
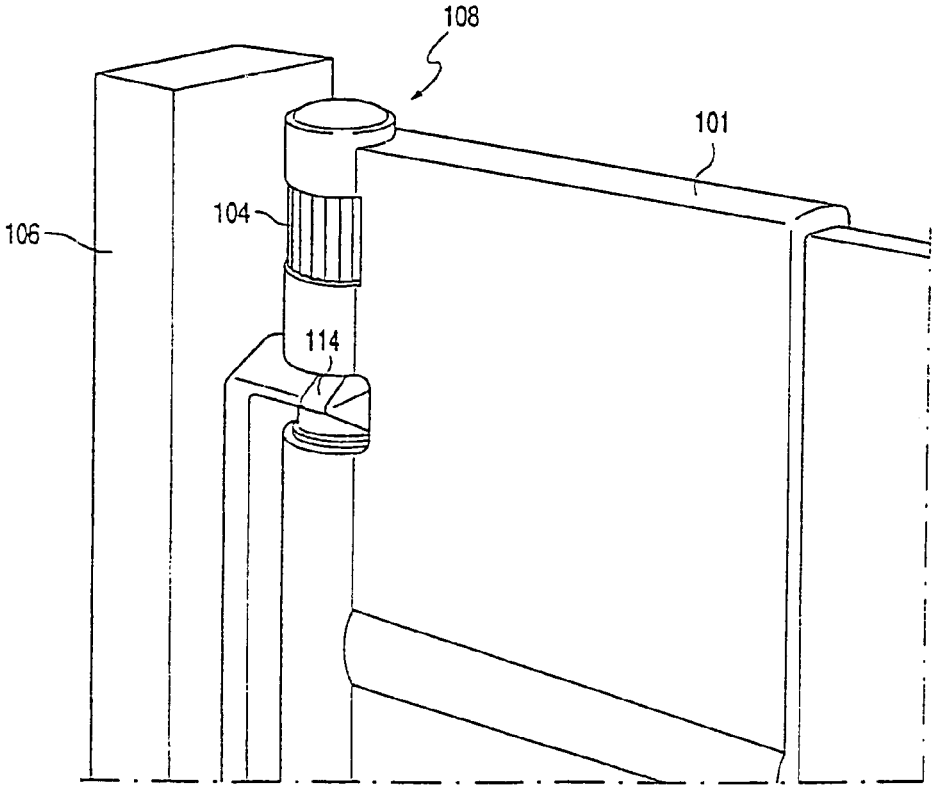
FIG. 9 shows a perspective detail view of a locking mechanism with deformable operating member according to the invention which is integrated with a stair gate.

FIG. 9 shows in detail a locking mechanism 108 with a sleeve 104 with which a latching member (not shown) can be rotated when the sleeve is sufficiently compressed. Stop 107 is provided with a v-shaped slot 114 whereby a locking pin can be pressed into a locked position without the locking pin having to be lifted for this purpose. This simplifies closing of stair gate 101; for closure it only has to be urged with some pressure against stop 107 and the gate 101 is locked. The substantially v-shaped slot 114 is designed such that stair gate 101 cannot be opened only by exerting pressure thereon. In order to open gate 101 the locking pin must be lifted, which is only possible by simultaneously deforming and rotating sleeve 104.

Figure 10:
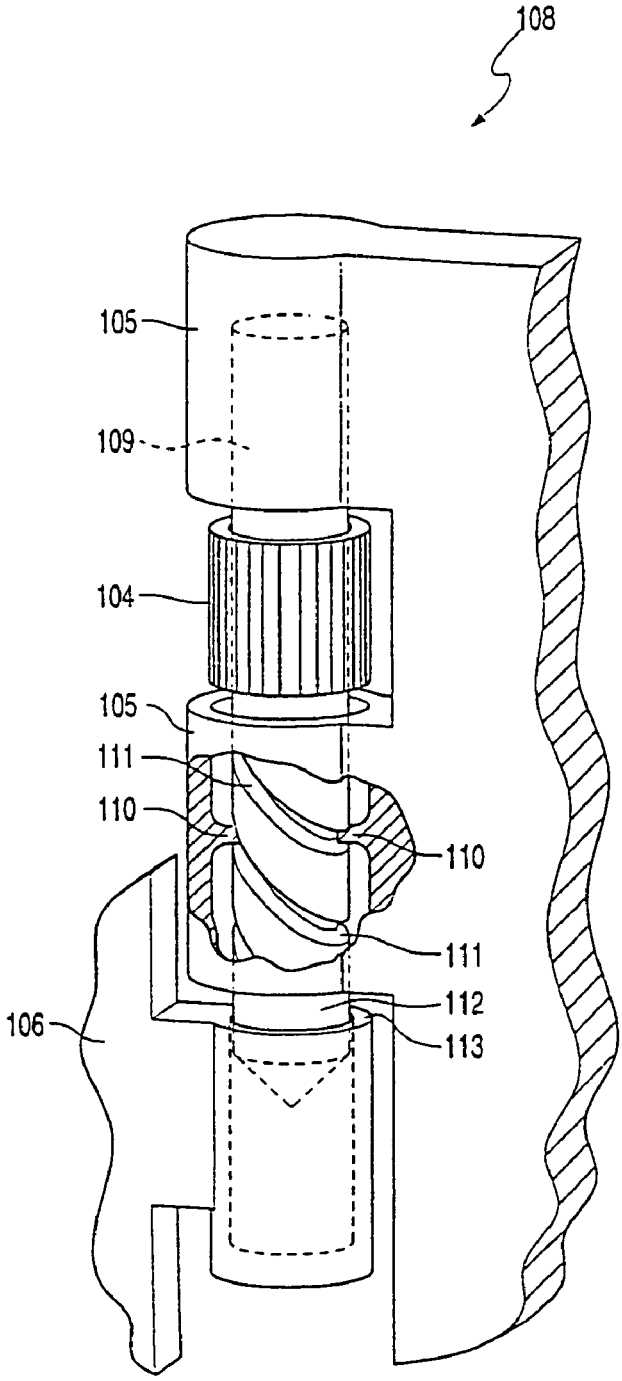
FIG. 10 is a cut-away view of the locking mechanism shown in FIG. 9.

FIG. 10 shows a cut-away detail view of locking mechanism 108 with a latching member 109 round which lies sleeve 104. The projecting parts 105 of stair gate 101 also enclose latching member 109. Shown in one of the projecting parts 105 are guide pins 110 which engage on helical grooves 111 in the outer surface of latching member 109. The lower part of latching member 109 in this figure is also designated as locking pin 112 and co-acts with a pin housing 113 which is connected to fixed components by means of upright 106. Other than in FIG. 9, the v-shaped slot 114, which makes closing of stair gate 101 more difficult, is absent in the embodiment shown in this figure. For locking purposes the latching member 109 will now in any case also have to be lifted by operating the sleeve 104.

Figure 11:
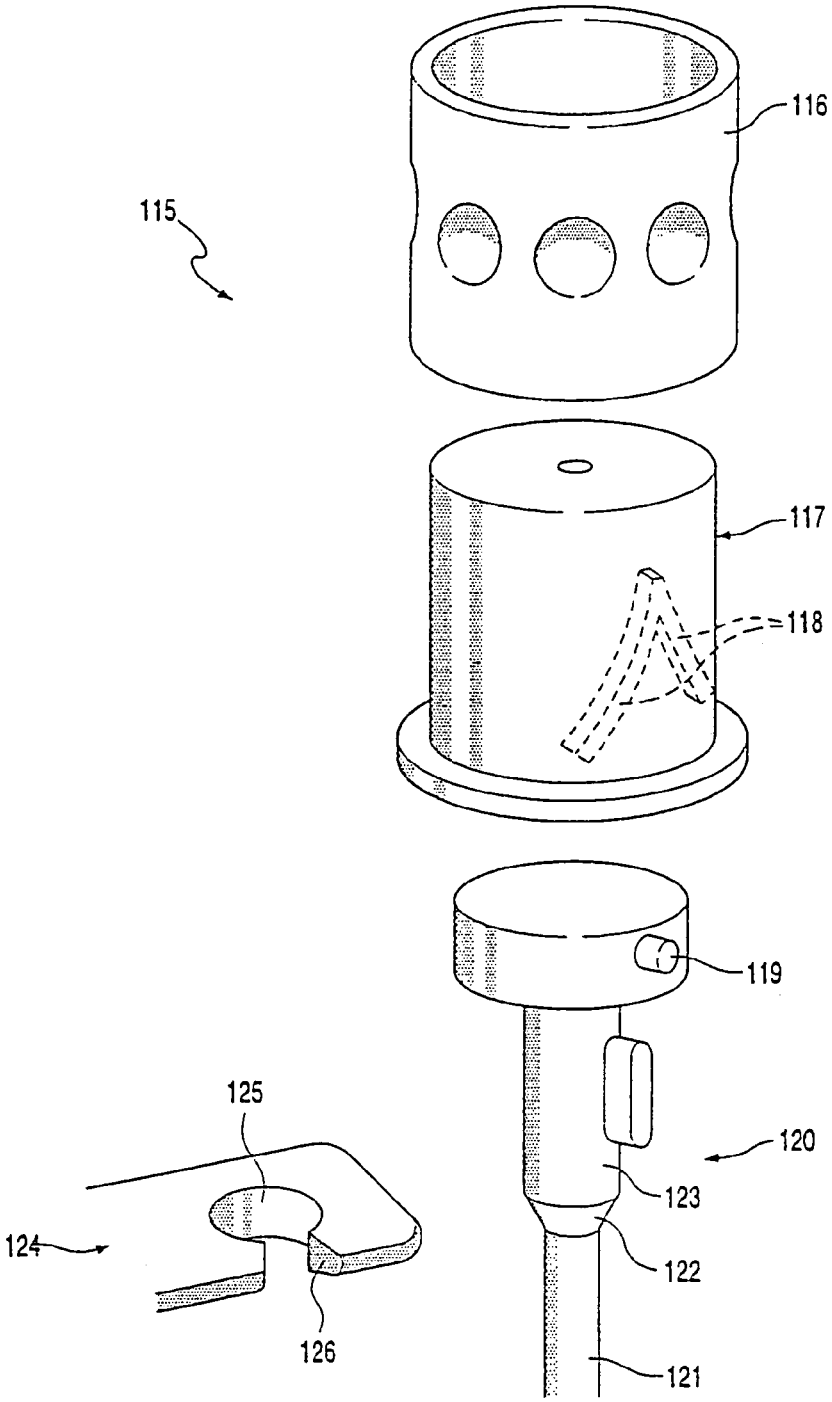
FIG. 11 shows a perspective schematic view of an alternative embodiment of the locking mechanism with exploded parts with deformable operating member according to the invention.

The locking mechanism 115 shown in FIG. 11 comprises a sleeve 116 which is deformable and which in non-deformed state is rotatable round a bush 117 with a substantially smooth exterior. When sleeve 116 is deformed and rotated the bush 117 will co-rotate. Bush 117 is mounted for rotation at a fixed position in a stair gate 105, not shown in this figure. On the inside of bush 117 is arranged a helical guide 118 which engages on a pin 119 which forms part of a locking bar 120. By rotating bush 117 the locking bar can be lifted in order to thus release locking mechanism 115.

Locking bar 120 is freely displaceable in axial direction relative to bush 117 which, as already stated, is not displaceable in axial direction. The lower part 121 of locking bar 120, which has a limited diameter, transposes by means of a conical transition portion 122 into the middle part 123 of locking bar 120 which has a greater diameter than the lower part 121. Locking bar 120 co-acts with a lock plate 124 provided with an opening 125. Connecting onto opening 125 is a v-shaped slot 126 which is open toward the edge of lock plate 124. This construction has the advantage that locking bar 120 can be carried into a locked position, i.e. with middle part 123 of locking bar 120 received in opening 125, without the bush 117 and sleeve 116 having to be rotated for this purpose. When locking mechanism 115 is "slammed shut", the transition portion 122 comes into contact with v-shaped slot 126 and locking bar 120 is urged upward to a limited extent by the form of transition portion 122 and slot 126. The dimension of slot 126 is such that the lower part 121 of locking bar 120 can pass through such that it comes to lie in the opening 125. Since here there is no upward directed force thereon, the locking bar 120, optionally assisted by a spring (not shown), will move downward over a limited distance owing to the free axial displaceability relative to bush 117, so that the middle part 123 is enclosed by lock plate 124. In this situation the locking mechanism is locked and can only be released by lifting locking bar 120. Locking mechanism 120 can thus be closed very simply without this requiring operation by means of sleeve 115, while this does not result in reduced safety in the locked situation.

Figure 12:
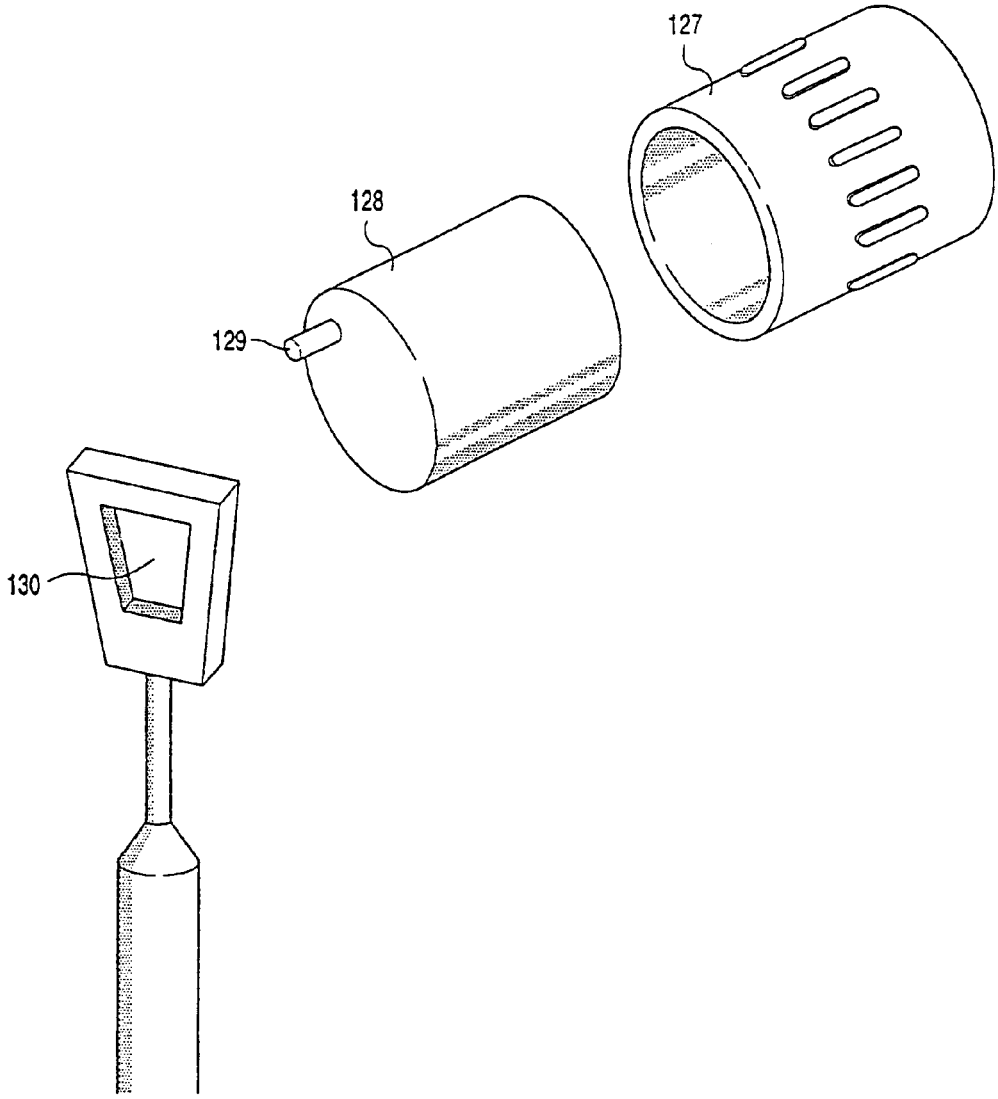
FIG. 12 is a perspective schematic view of yet another alternative embodiment of the locking mechanism with deformable closing member according to the invention, of which only the most elementary parts are shown in exploded view

Yet another embodiment is shown schematically in FIG. 12. A horizontally mounted sleeve 127 herein engages in deformed state on a bush 128. An end side of bush 128 is provided with an eccentrically placed pin 129. This pin 129 engages in an opening 130 of a locking bar 131. By rotating bush 128 the pin 129 can displace locking bar 131 upward by means of engaging on the upper edge of opening 130.

The invention claimed is:

1. A locking mechanism for a stair gate, comprising a displaceable latching mechanism and an operating element which can engage on the latching mechanism, wherein in a non-loaded state the operating element substantially releases the latching mechanism and in a loaded state the operating element engages on the latching mechanism, the operating element is loaded in a direction varying from an operating direction of the latching mechanism to engage the operating element on the latching mechanism, wherein the latching mechanism comprises a pin with a wide part and a narrow part and a latching member, said latching member comprises a hole with a relevant dimension greater than a relevant dimension of the wide part of the pin and a slot extending from an outer surface of said latching member to the hole, said slot has a width greater than a relevant dimension of the narrow part of the pin and smaller than the relevant dimension of the wide part of the pin, wherein the operating direction comprises movement between a locked and an unlocked position by axial displacement of the pin.

2. The locking mechanism as claimed in claim 1, wherein the operating element is deformable.

3. The locking mechanism as claimed in claim 2, wherein the operating element is manufactured from a flexible plastic.

4. The locking mechanism as claimed in claim 1, wherein the pin is mounted displaceably in at least one guide.

5. The locking mechanism as claimed in claim 1, wherein the latching mechanism is provided with a profiled surface part for co-action with a contact surface of the operating element.

6. The locking mechanism as claimed in claim 1, wherein said pin is remote from the operating element.

7. The locking mechanism as claimed in claim 6, wherein the operating element is rotatable with respect to the pin.

8. The locking mechanism as claimed in claim 1, wherein the latching mechanism is provided with a substantially helical guide.

9. A gate comprising at least one hinge for hingedly mounting the gate on a first vertical part; and a locking mechanism for releasably coupling the gate to a second vertical part, the locking mechanism comprising a displaceable latching mechanism and an operating element which can engage on the latching mechanism, wherein in a non-loaded state the operating element substantially releases the latching mechanism and that in a loaded state the operating element engages on the latching mechanism the operating element is loaded in a direction varying from an operating direction of the latching mechanism to engage the operating element on the latching mechanism, wherein the locking mechanism is received in the gate such that the latching mechanism is moveable relative to the gate, and wherein the latching mechanism comprises a pin with a wide part and a narrow part and a latching member, said latching member comprises a hole with a relevant dimension greater than a relevant dimension of the wide part of the pin and a slot extending from an outer surface of the latching member to the hole, said slot has a width greater than a relevant dimension of the narrow part of the pin and smaller than the relevant dimension of the wide part of the pin, wherein the operating direction comprises movement between a locked and an unlocked position by axial displacement of the pin.

10. The gate as claimed in claim 9, wherein the latching mechanism is arranged for axial rotation and the operating element is arranged rotatably and coaxially with the latching mechanism.

11. The gate as claimed in claim 9, wherein the latching member comprises an upper surface running obliquely upward, wherein the relatively wide part of the pin undergoes an axial displacement when the pin slides thereover.

12. The gate as claimed in claim 9, wherein the gate additionally comprises a first plate part;

a second plate part; and guide means for slidably guiding the plate parts parallel to each other such that the horizontal dimension of the gate can be adjusted to the horizontal distance between the vertical parts.

* * * * *